US005621918A

United States Patent [19]

Bernhard

[11] Patent Number: 5,621,918

[45] Date of Patent: Apr. 22, 1997

[54] GOLF GLOVE

[76] Inventor: Philip T. Bernhard, 1361 Lower Ferry Rd., Trenton, N.J. 08618

[21] Appl. No.: 620,075

[22] Filed: Mar. 21, 1996

[51] Int. Cl.[6] ..... A41D 19/00

[52] U.S. Cl. ..... 2/161.2; 2/163

[58] Field of Search ..... 2/159, 160, 161.1, 2/161.2, 161.3, 161.4, 163; 273/187.2, 188 R

[56] References Cited

U.S. PATENT DOCUMENTS

| | | | |
|---|---|---|---|
| 2,379,430 | 7/1945 | Frost | 2/161.2 |
| 2,474,030 | 6/1949 | Braswell | 2/161.2 |
| 2,782,422 | 2/1957 | Bencriscutto | 2/161.2 |
| 3,930,271 | 1/1976 | Kahng | 2/161.4 |

*Primary Examiner*—Michael A. Neas
*Attorney, Agent, or Firm*—Stroock & Stroock & Lavan

[57] ABSTRACT

A glove is provided for use by a wearer playing golf, the glove to be worn on the wearer's leading hand for maintaining a consistent and secure interlocking grip without slippage and without irritation or chafing of the following hand pinky finger or the leading hand index and middle fingers. The glove comprises a palm portion, a top hand portion, and a plurality of finger coverings including at least a leading hand index finger covering, a leading hand middle finger covering and a following hand pinky finger covering. A following hand finger covering is disposed between the adjacent finger covering of the leading hand glove. In a preferred embodiment, a following hand pinky finger covering is disposed between the leading hand index and middle finger coverings so as to provide coverings for all three fingers when a golf club handle is gripped in an interlocking grip, thus securing the following hand pinky finger in the correct position and protecting said pinky finger from chafing and irritation as a result of contact with the leading hand index and middle fingers or their respective coverings.

7 Claims, 3 Drawing Sheets

GOLF GLOVE

BACKGROUND OF THE INVENTION

This invention relates generally to a golf glove, and more particularly to a golf glove which helps a golfer maintain a secure and comfortable interlocking grip of the hands around a golf club handle.

All successful golfers share one common trait: consistency. To achieve this consistency, a successful golfer maintains the proper interlocking grip of the hands around the golf club handle on every stroke. A proper grip begins by laying the handle of the golf club diagonally across the palm and fingers of the uppermost or "leading" hand (the left hand for right-handed golfers; the right hand for left-handed golfers), in a line running generally from the second joint from the tip of the index finger to the crease in the outer edge of the palm approximately ½" to 1" below base of the pinky. The handle is held in such a way that the club head is pointing away from the body. The leading hand is then gently wrapped around the club handle with the thumb pointing directly down the handle toward the club head. Next, the other hand (the "following" hand) is placed on the club handle below the leading hand (that is, closer to the club head) such that the following hand pinky finger is held between the index and middle fingers of the leading hand to form an interlocking hand grip. The following hand is then also wrapped around the club handle, at which point the ball of the following hand thumb should be positioned atop the leading hand thumb.

If this proper interlocking grip is achieved and maintained, a golfer can obtain significant consistency from stroke to stroke. However, the consistency achieved by successful golfers invariably results from a great deal of practice, which itself entails an enormous number of strokes using the same interlocking grip each time. Repeatedly maintaining the interlock of the following hand pinky finger between the index and middle fingers of the leading hand can be difficult, especially when the golfer becomes weary after many such strokes during the same outing. Moreover, the repetitious gripping of the following hand pinky finger between the leading hand index and middle fingers can cause discomfort and skin irritation on all three fingers due to chafing. In addition, the interlocking grip is prone to slippage as a result of fatigue or when these fingers become wet due to rain, sweat and the like.

To alleviate some of these problems, many golfers wear a conventional glove on their leading hand. Such gloves typically have five finger openings, one for each of the fingers of the leading hand. While such gloves help prevent chafing on and between the index and middle fingers of the leading hand, these gloves do not prevent such chafing and irritation on the following hand pinky finger. In fact, these gloves are typically made of material which is rougher than human skin and therefore tend to increase the irritation and chafing of the following hand pinky finger. Further, these conventional gloves do nothing to help stabilize the following hand pinky finger in the proper position relative to the leading hand, and without slippage, to ensure a secure interlocking grip. Even if two gloves are used, neither glove ensures that the following hand pinky finger is stabilized in the proper position for a secure interlocking grip.

Accordingly, it is desired to provide a golf glove covering the leading hand which helps a golfer maintain a consistent and secure interlocking grip without slippage and without irritation or chafing of the following hand pinky finger or the leading hand index and middle fingers.

SUMMARY OF THE INVENTION

A glove is provided for use by a wearer playing golf, the glove to be worn on the wearer's leading hand for maintaining a consistent and secure interlocking grip without slippage and without irritation or chafing of the following hand pinky finger or the leading hand index and middle fingers. The glove comprises a palm portion, a top hand portion, and a plurality of finger coverings including at least a leading hand index finger covering, a leading hand middle finger covering and a following hand pinky finger covering. A following hand finger covering is disposed between the adjacent finger coverings of the leading hand glove. In a preferred embodiment, a following hand pinky covering is disposed between the leading hand index and middle finger coverings so as to provide coverings for all three fingers when a golf club handle is gripped in an interlocking grip, thus stabilizing the following hand pinky finger in the correct position relative to the leading hand and protecting said pinky finger from chafing and irritation as a result of contact with the leading hand index and middle fingers or their respective coverings.

Accordingly, it is an object of this invention to provide a golf glove which helps a golfer maintain a consistent and secure interlocking grip of the hands about a golf club handle.

Another object of this invention is to provide a golf glove which prevents irritation and chafing of the following hand pinky finger and the leading hand index and middle fingers.

A further object of this invention is to provide a golf glove for a golfer's leading hand which stabilizes the following hand pinky finger relative to the leading hand.

A still further object of this invention is to provide an athletic glove for a wearer's leading hand which anchors the hands together in an appropriate grip.

Still other objects and advantages of the invention will in part be obvious and will in part be apparent from the specifications and drawings.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
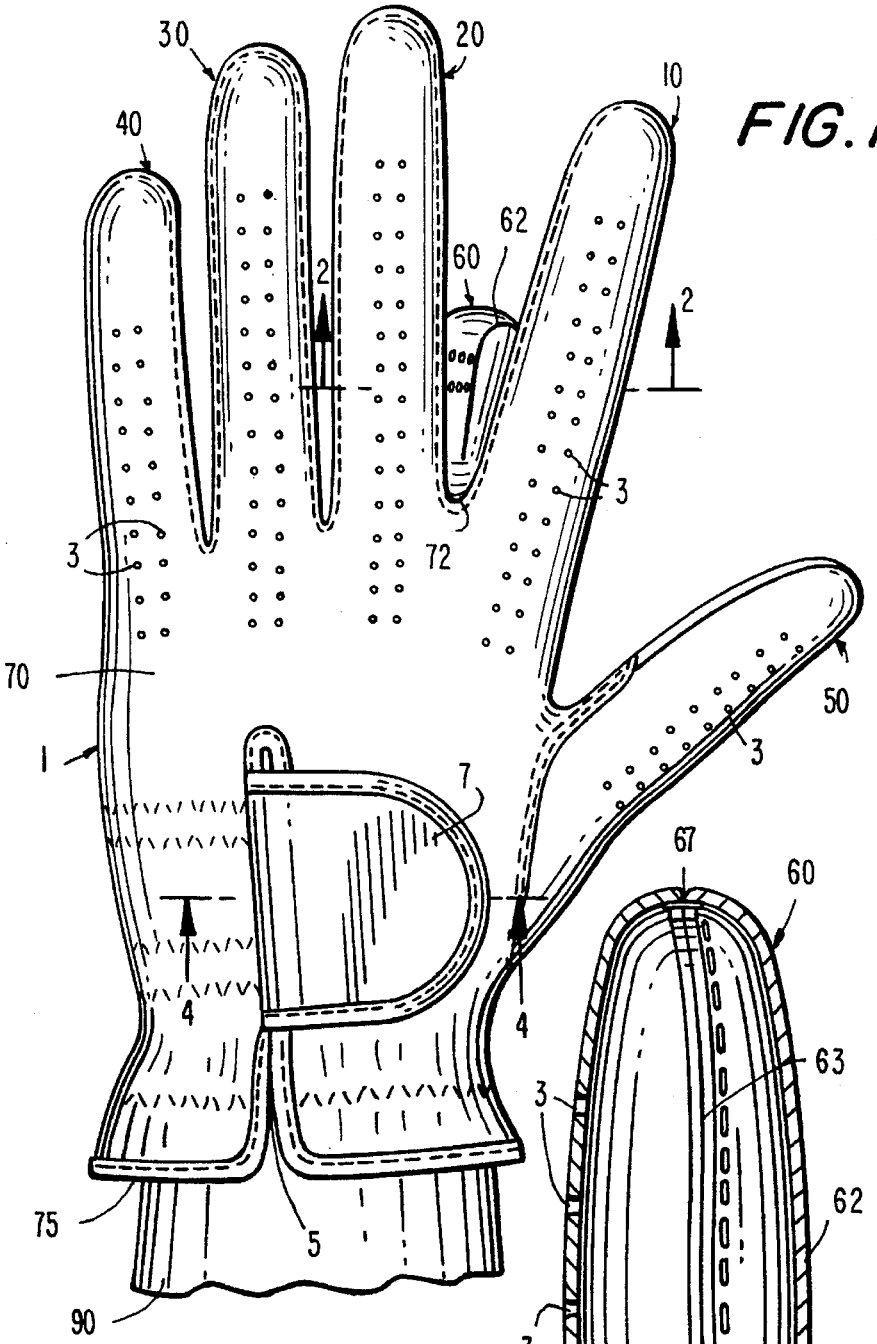
FIG. 1 is a top plan view of a golf glove according to the present invention.

Reference is now made to FIGS. 1–6 wherein a golf glove, generally indicated as 1 and constructed in accordance with the invention, is provided. The golf glove depicted and described in detail herein is for use by a right-handed golfer on the leading hand (that is, the upper hand on the golf club). Accordingly, golf glove 1 as shown covers the left hand. The glove of the present invention fitted for a left-handed golfer would cover the right hand. Golf glove 1 includes a top hand portion 70, a palm portion 80 and a plurality of finger coverings 10, 20, 30, 40, 50 and 60.

Top hand portion 70 communicates with palm portion 80 to form a covering for a wearer's hand with an opening 75 for receiving the leading fingers, hand and arm 90 of a wearer. A plurality of finger coverings 10, 20, 30, and 40, for the wearer's leading index, middle, ring and pinky fingers respectively, communicate with the top hand portion 70 and palm portion 80 at an end of the top hand portion 70 and palm portion 80 opposite opening 75. A finger covering 50 for the wearer's leading thumb communicates with the top hand portion 70 and palm portion 80 of the wearer's hand at a side of the top hand portion 70 and palm portion 80 between the opening 75 and the base of the index finger covering 10.

Figure 3:
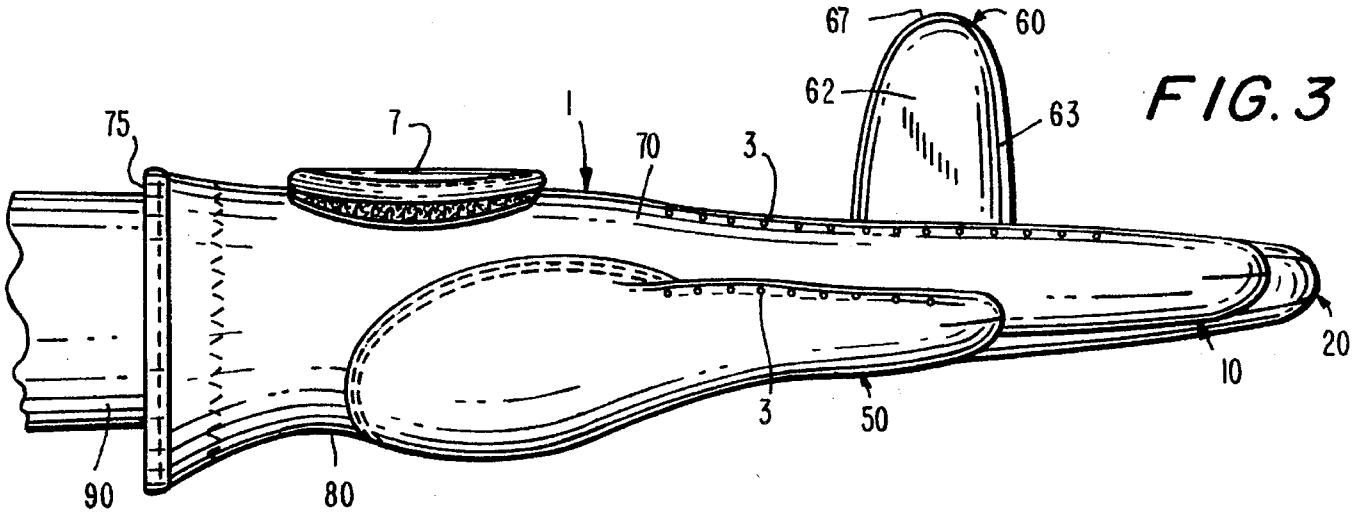
FIG. 3 is a side elevational view of a golf glove according to the present invention.
Figure 5:
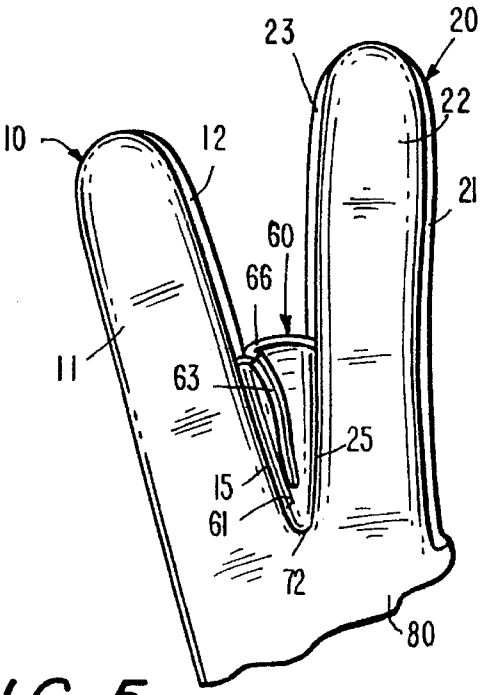
FIG. 5 is a bottom plan view of a portion of a golf glove according to the present invention showing the leading hand index and middle finger coverings and a following hand pinky covering.

As specifically shown in FIGS. 1, 3 and 5, golf glove 1 is also provided with a following pinky finger covering, generally indicated as 60, for receiving the pinky finger of the golfer's following hand. Following pinky finger covering 60 is disposed between index finger covering 10 and middle finger covering 20. More particularly, following pinky finger covering 60 is disposed adjacent to a crotch 72 formed at the juncture of index finger covering 10, middle finger covering 20, top hand portion 70 and bottom portion 80. Unlike leading finger coverings 10, 20, 30, 40 and 50 which provide openings to receive the wearer's leading hand fingers through the covering formed by top hand portion 70 and palm portion 80, following pinky finger covering 60 includes an opening 61, substantially coplanar with palm portion 80 when the glove is in an open position, for access from outside of this covering. Preferably, following pinky finger covering 60 is disposed substantially perpendicularly to the palm portion 80 and finger coverings 10, 20, 30, 40 and 50 when the fingers of the wearer's leading hand inside glove 1 are held straight out from the palm. Stated otherwise, the axis of the opening 61 in following pinky finger covering 60 is preferably generally perpendicular to the axes of the openings of the leading hand index finger covering 10 and the leading hand middle finger covering 20.

The length of following pinky finger covering 60 preferably coincides with the length of the wearer's following hand pinky finger as measured from its tip to the webbing between its base and the base of the adjacent ring finger. The inner diameter of following hand pinky finger covering 60 is preferably sufficiently large to permit a comfortable, unconstricted fit and to allow easy insertion and removal of the finger, yet also sufficiently close around the finger to prevent excess movement of the finger within covering 60.

Figure 2:
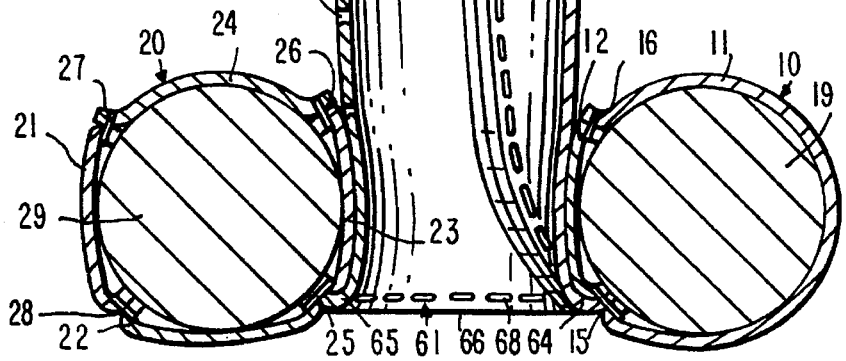
FIG. 2 is a sectional view of a golf glove according to the present invention taken along the line 2—2 of FIG. 1.

As shown in FIGS. 2 and 5, index finger covering 10 preferably comprises an outer panel 11 covering the top, bottom and outside of the index finger, and an inner panel 12 covering the inside of the index finger, which are fastened together by stitches to form seams 15 and 16 to define an index finger receiving area 19. Similarly, middle finger covering 20 preferably comprises an outer panel 21, a bottom panel 22, an inner panel 23 and a top panel 24, which are fastened together by stitches to form seams 25–28 as shown to define middle finger receiving area 29. As can be seen, stitched seams 15 and 25 are disposed substantially at the bottom side of glove 1.

Opening 61 of following pinky finger covering 60 is preferably disposed so as to offer access to the wearer's following hand pinky finger at the bottoms of index and middle finger coverings 10 and 20. Following pinky finger covering 60 preferably comprises a single panel 62 which is folded lengthwise and fastened to itself by stitches to form a seam 63 to form a generally tubular chamber, closed at the tip 67, for receiving the wearer's following hand pinky finger. The base of panel 62 preferably generally forms a triangle with rounded basal sides. A first basal side 64 of panel 62 is secured between outer panel 11 and inner panel 12 of index finger covering 10 at stitched seam 15. A second basal side 65 of panel 62 is secured between bottom panel 22 and inner panel 23 of middle finger covering 20 at stitched seam 25. Finally, a third basal side 66 of panel 62 remains unattached to either index finger covering 10 or middle finger covering 20 to allow the wearer's index and middle fingers to be freely moved apart. To prevent ripping or fraying of the material comprising panel 62, third basal side 66 preferably includes stitches 68 near and parallel to the cut end of the material as shown in FIG. 2.

Figure 6:
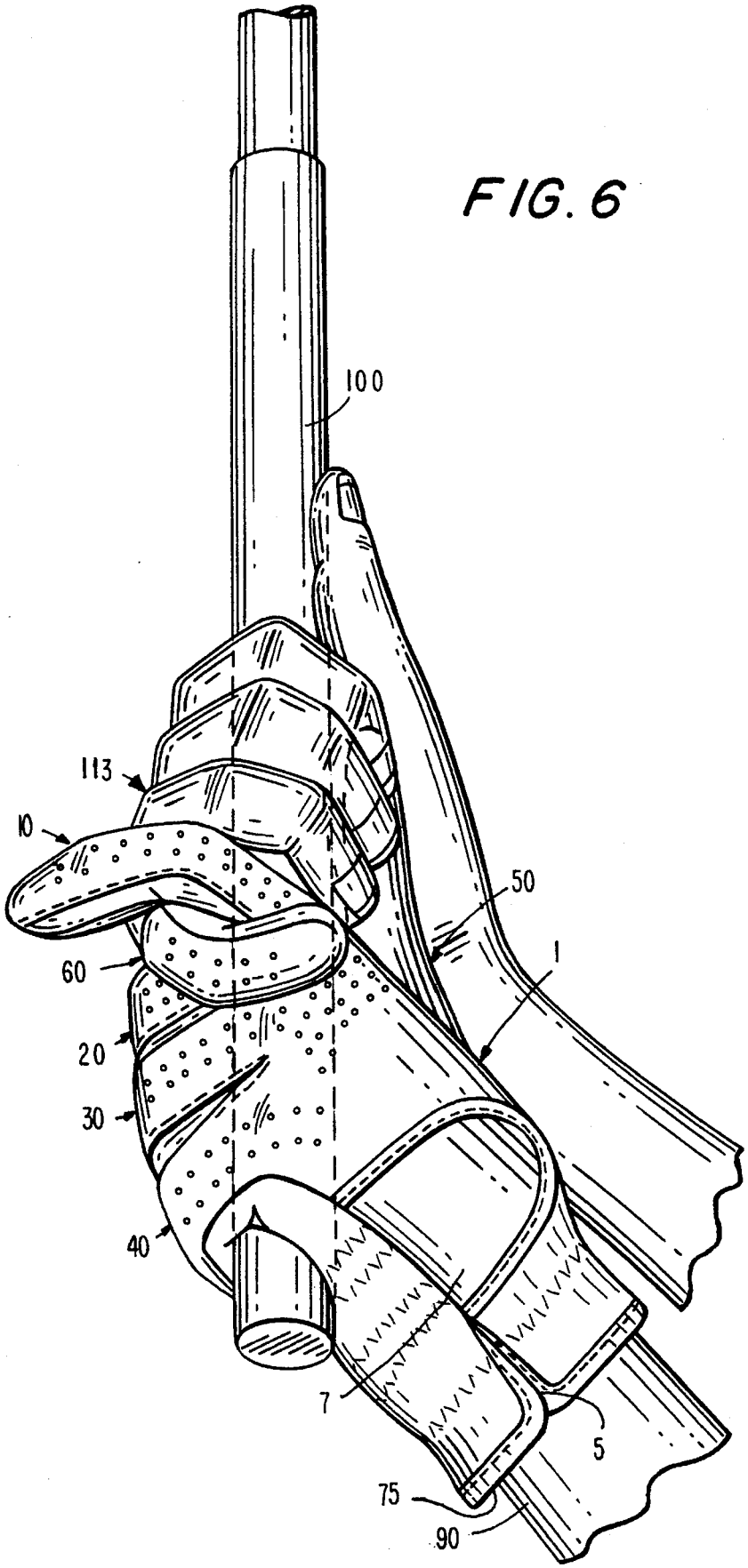
FIG. 6 is a perspective view of the hands of a golfer wearing a golf glove according to the present invention and gripping a golf club handle.

Reference is now had to FIG. 6 wherein a golfer's hands are shown gripping a golf club handle 100 using glove 1 of the present invention. To secure a proper grip on a golf club, a golfer dons golf glove 1 on the leading hand. With the fingers of the leading hand open, the golfer places the head of the golf club on the ground, pointing away from the golfer's body, and then lays golf club handle diagonally across the palm portion 80 and several of the finger coverings, including index finger covering 10. The golfer then gently wraps the fingers of the leading hand around golf club handle 100 with the thumb pointing directly down the handle toward the club head. Next, the following hand is placed on golf club handle 100 below the leading hand (that is, closer to the club head) such that the following hand pinky finger is inserted into following pinky finger covering 60 of glove 1. Accordingly, the following hand pinky finger is anchored between the index and middle fingers of the leading hand in coverings 10 and 20 respectively. Moreover, the wearer's leading hand index finger is held between the pinky finger in covering 60 and the ring finger 113 of the following hand. The following hand is then also wrapped around the club handle, at which point the ball of the following hand thumb should be positioned atop the leading hand thumb. Thus, a secure interlocking grip is formed between the leading and following hands wherein the following hand is held securely in position relative to the leading hand by virtue of the following pinky finger covering 60 which is attached to and held in position by golf glove 1 on the leading hand. In this position, the following hand pinky finger is not only stabilized and held securely in position relative to the leading hand, but is also protected from chafing and irritation which would otherwise result from repeated contact with the index and middle fingers of the following hand or their coverings.

Figure 4:
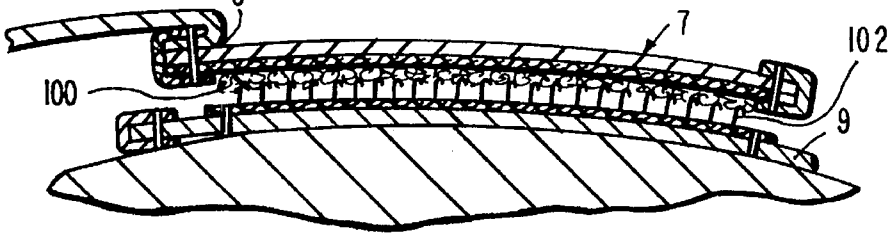
FIG. 4 is a sectional view of a golf glove according to the present invention taken along the line 4—4 of FIG. 1.

As shown in FIGS. 1–4 and 6, various modifications may be made to the glove to vary the fit and aesthetic appearance of glove 1. For instance, a plurality of holes 3 may be provided in the tops and/or bottoms of the finger coverings 10, 20, 30, 40, 50 and 60 to allow air to pass within and without of the glove during use, thereby providing ventilation to the hand. As shown in FIGS. 1 and 4, a slit or gather 5 may also be provided on the top hand portion 70 with an adjustable strap 7 having loop fasteners 100 formed thereon attached to one side 8 of the slit or gather 5. Hook fasteners 102 are mounted on the other side 9 of the slit or gather 5 in facing relationship with loop fasteners 100 to selectively attach therewith to enlarge or constrict the opening 75 of the glove 1 about the wearer's hand or wrist.

Moreover, the panels and stitching used to construct the glove may be varied according to available materials, manufacturing capabilities and the desired appearance of the overall glove. For instance, following pinky finger covering may comprise a plurality of panels stitched appropriately to define a suitable following pinky finger receiving area. As a further alterative to the preferred embodiment described herein, following pinky covering 60 may be sewn near the top portions of index and middle finger coverings 10 and 20.

By providing a leading hand golf glove with a following pinky finger covering disposed between the coverings for the index and middle fingers of the leading hand, a golfer wearing such a glove may maintain a consistent and secure interlocking grip without slippage and without irritation or chafing of the following hand pinky finger or the leading hand index and middle fingers.

Furthermore, the use of such a glove for golf has been by way of example only. The opposite hand finger covering portion may be placed between the thumb and index finger to accommodate the opposite hand pinky in a grip of a baseball bat, for instance.

It will thus be seen that the objects set forth above, and those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A glove for use by a wearer, the glove to be worn on a wearer's first hand, comprising:

a palm portion for covering the palm of the wearer's hand;

a top hand portion for covering the top of the wearer's hand, the top hand portion communicating with the palm portion so as to form a first opening for receiving the fingers of the leading hand and the leading hand; and a plurality of finger coverings communicating with the palm portion and the top hand portion at a first end of the palm portion and top hand portion opposite the first opening, said plurality of finger coverings including at least a first finger covering and a second finger covering, each of said first finger covering and said second finger covering having an opening with an axis; and an opposite hand finger covering for receiving a finger of the wearer's opposite hand, the opposite hand finger covering being disposed between said first finger covering and said second finger covering, said opposite hand finger covering having an opening with an axis, wherein the axis of the opposite hand finger covering opening is substantially perpendicular to the axes of the first finger covering opening and the second finger covering opening.

2. A glove for use by a wearer for playing golf, the glove to be worn on the wearer's leading hand, comprising:

a palm portion for covering the palm of the wearer's hand;

a top hand portion for covering the top of the wearer's hand, the top hand portion communicating with the palm portion so as to form a first opening for receiving the fingers of the leading hand and the leading hand; and a plurality of finger coverings communicating with the palm portion and the top hand portion at a first end of the palm portion and top hand portion opposite the first opening, said plurality of finger coverings including at least a leading index finger covering and a leading middle finger covering, each of said leading index finger covering and leading middle finger covering having an opening with an axis; and a following pinky finger covering for receiving the pinky finger of the following hand, the following pinky finger covering being disposed between the leading index finger covering and the leading middle finger covering, said following pinky finger covering having an opening with an axis, wherein the axis of the following pinky finger covering opening is substantially perpendicular to the axes of the leading index finger covering opening and the leading middle finger covering opening.

3. The golf glove of claim 2, wherein the following pinky finger covering has a base with three basal sides, and wherein a first basal side is attached to the leading index finger covering and a second basal side is attached to the leading middle finger covering.

4. The golf glove of claim 3, wherein the first basal side at attached to the leading index finger covering along a first seam in the leading index finger covering, and the second basal side is attached to the leading middle finger covering along a second seam in the leading middle finger covering.

5. The golf glove of claim 4, wherein a third basal side includes stitching to prevent ripping or tearing of the following pinky finger covering.

6. The golf glove of claim 2, wherein the following pinky finger covering comprises a single panel.

7. The golf glove of claim 2, wherein the following pinky finger covering is attached substantially at the bottoms of the leading index finger covering and leading middle finger covering.

* * * * *